US009987605B2

(12) United States Patent
Martin et al.

(10) Patent No.: US 9,987,605 B2
(45) Date of Patent: Jun. 5, 2018

(54) METHOD FOR MULTI-AXIS, NON-CONTACT MIXING OF MAGNETIC PARTICLE SUSPENSIONS

(71) Applicant: National Technology & Engineering Solutions of Sandia, LLC, Albuquerque, NM (US)

(72) Inventors: James E. Martin, Tijeras, NM (US); Kyle J. Solis, Rio Rancho, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 455 days.

(21) Appl. No.: 14/957,056

(22) Filed: Dec. 2, 2015

(65) Prior Publication Data

US 2017/0157580 A1 Jun. 8, 2017

(51) Int. Cl.

| | |
|---|---|
| ***B01F 13/00*** | (2006.01) |
| ***B01F 13/08*** | (2006.01) |
| ***B01F 5/00*** | (2006.01) |

(52) U.S. Cl.
CPC ..... *B01F 13/0809* (2013.01); *B01F 5/0057* (2013.01)

(58) Field of Classification Search
CPC ..... B01F 13/0809; B01F 5/0057
USPC ..... 366/273, 274
See application file for complete search history.

(56) References Cited

U.S. PATENT DOCUMENTS 6,844,378 B1 * 1/2005 Martin ..... B82Y 25/00 204/557
9,470,458 B1 10/2016 Martin et al.

OTHER PUBLICATIONS

Martin, J. E., "Theory of Strong Intrinsic Mixing of Particle Suspensions in Vortex Magnetic Fields", Physical Review E, 2009, 011503, vol. 79, pp. 011503-1-011503-12.
Martin, J. E. et al., "Symmetry-Breaking Magnetic Fields Create a Vortex Fluid That Exhibits a Negative Viscosity, Active Wetting, and Strong Mixing", Soft Matter, 2014, vol. 10, pp. 3993-4002.
Solis, K. J. et al., "Torque Density Measurements on Vortex Fluids Produced by Symmetry-Breaking Rational Magnetic Fields", Soft Matter, 2014, vol. 10, pp. 6139-6146.
Martin, J. E. et al., "Fully Alternating, Triaxial Electric or Magnetic Fields Offer New Routes to Fluid Vorticity", Soft Matter, 2015, vol. 11, pp. 241-254.
Martin, J. E. et al., "Strong Intrinsic Mixing in Vortex Magnetic Fields", Physical Review E, 2009, 016312, vol. 80, pp. 016312-1-016312-6.

(Continued)

*Primary Examiner* — Anshu Bhatia
(74) *Attorney, Agent, or Firm* — Kevin W. Bieg

(57) ABSTRACT

Continuous, three-dimensional control of the vorticity vector is possible by progressively transitioning the field symmetry by applying or removing a dc bias along one of the principal axes of mutually orthogonal alternating fields. By exploiting this transition, the vorticity vector can be oriented in a wide range of directions that comprise all three spatial dimensions. Detuning one or more field components to create phase modulation causes the vorticity vector to trace out complex orbits of a wide variety, creating very robust multiaxial stirring. This multiaxial, non-contact stirring is particularly attractive for applications where the fluid volume has complex boundaries, or is congested.

20 Claims, 14 Drawing Sheets

(56) References Cited

OTHER PUBLICATIONS

Kokot, G. et al., "Emergent Coherent States and Flow Rectification in Active Magnetic Colloidal Monolayers", Soft Matter, 2013, vol. 9, pp. 6757-6760.
Snezhko, Alexey, "Non-Equilibrium Magnetic Colloidal Dispersions at Liquid-Air Interfaces: Dynamic Patterns, Magnetic Order and Self-Assembled Swimmers", J Phys: Condens. Matter, 2011, 153101, vol. 23, pp. 1-21.
Belkin, M. et al., "Driven Magnetic Particles on a Fluid Surface: Pattern Assisted Surface Flows", Physical Review Letters, 2007, 158301, vol. 99, pp. 158301-1-158301-4.
Belkin, M. et al., "Model for Dynamic Self-Assembled Magnetic Surface Structures", Physical Review E, 2010, 015301, vol. 82, pp. 015301-1-015301-4.
Piet, D. L. et al., "Viscosity Control of the Dynamic Self-Assembly in Ferromagnetic Suspensions", Physical Review Letters, 2013, 198001, vol. 110, pp. 198001-1-198001-5.
Martin, James E., "A Resonant Biaxial Helmholtz Coil Employing a Fractal Capacitor Bank", Review of Scientific Instruments, 2013, 094704, vol. 84, pp. 094704-1-094704-11.
Martin, J. E. et al., "Mesmerizing Magnetic Fields", Physics Today, Aug. 2015, pp. 66-67.
Solis, K. J. et al., "Isothermal Magnetic Advection: Creating Functional Fluid Flows for Heat and Mass Transfer", Applied Physics Letters, 2010, 034101, vol. 97, pp. 034101-1-034101-3.
Solis, K. J. et al., "Stimulation of Vigorous Rotational Flows and Novel Flow Patterns Using Triaxial Magnetic Fields", Soft Matter, 2012, vol. 8, pp. 11989-11994.
Solis, K. J. et al., "Complex Magnetic Fields Breathe Life Into Fluids", Soft Matter, 2014, vol. 10, pp. 9136-9142.

* cited by examiner

METHOD FOR MULTI-AXIS, NON-CONTACT MIXING OF MAGNETIC PARTICLE SUSPENSIONS

STATEMENT OF GOVERNMENT INTEREST

This invention was made with Government support under contract no. DE-AC04-94AL85000 awarded by the U. S. Department of Energy to Sandia Corporation. The Government has certain rights in the invention.

FIELD OF THE INVENTION

The present invention relates to fluidic mixing and, in particular, to a method of multi-axis non-contact mixing of magnetic particle suspensions.

BACKGROUND OF THE INVENTION

In the last few years it has been shown that a wide variety of triaxial magnetic fields can produce strong fluid vorticity. See J. E. Martin, *Phys. Rev. E: Stat., Nonlinear, Soft Matter Phys.* 79, 011503 (2009); J. E. Martin and K. J. Solis, *Soft Matter* 10, 3993 (2014); K. J. Solis and J. E. Martin, *Soft Matter* 10, 6139 (2014); J. E. Martin and K. J. Solis, *Soft Matter* 11, 241 (2015); and U.S. application Ser. No. 12/893,104, each of which is incorporated herein by reference. These fields are comprised of three mutually orthogonal field components, of which either two or three are alternating, and whose various frequency ratios are rational numbers. These dynamic fields generally lack circulation, in that a magnetically soft ferromagnetic rod subjected to one of these fields does not undergo a net rotation during a field cycle. Yet these fields do induce deterministic vorticity, which might seem counterintuitive. For this deterministic vorticity to occur it must be reversible. This reversibility is possible if the trajectory of the field and its physically equivalent converse, considered jointly, is reversible. This field parity occurs because the symmetry of this union of fields is shared by vorticity, which is reversible.

An analysis of the symmetry of these fields enables the prediction of the vorticity axis, which is determined solely by the relative frequencies of the triaxial field components. For these fields changing the relative phases of the components enables control of the magnitude and sign of the vorticity—and in some cases changing the sign of the dc field also reverses flow—but not the axis around which vorticity occurs. Thus, when the frequency of one of the field components is detuned slightly to cause a slow phase modulation, the vorticity will periodically reverse, but it remains fixed around a single axis. Such flows produce a simple form of periodic stirring, as occurs in a washing machine.

The present invention goes well beyond this simple form of stirring and is based on transitions in the symmetry of the triaxial field.

SUMMARY OF THE INVENTION

According to the present invention, a method for non-contact mixing a suspension of magnetic particles comprises providing a fluidic suspension of magnetic particles; applying a triaxial magnetic field to the fluidic suspension, the triaxial magnetic field comprising three mutually orthogonal magnetic field components, at least two of which are ac magnetic field components wherein the frequency ratios of the at least two ac magnetic field components are rational numbers, thereby establishing vorticity in the fluidic suspension having an initial vorticity axis parallel to one of the mutually orthogonal magnetic field components; and progressively transitioning the symmetry of the triaxial magnetic field to a different symmetry, thereby causing the vorticity axis to reorient from the initial vorticity axis to a vorticity axis parallel to a different mutually orthogonal magnetic field component. For example, the volume fraction of magnetic particles can be greater than 0 vol. % and less than 64 vol. %. The magnetic particles can be spherical, acicular, platelet or irregular in form. The magnetic particles can be suspended in a Newtonian or non-Newtonian fluid or suspension that enables vorticity to occur at the operating field strength of the triaxial magnet. For example, the strength of each of the magnetic field components can be greater than 5 Oe. For example, the frequencies of the at least two ac field components can be between 5 and 10000 Hz. The ac frequency can be tuned along at least one of the ac magnetic field components. The relative phase of at least one of the ac magnetic field components can be adjusted.

It has recently been shown by the inventors that two types of triaxial electric or magnetic fields can drive vorticity in dielectric or magnetic particle suspensions, respectively. The first type—symmetry-breaking rational fields—consists of three mutually orthogonal fields, two alternating and one dc, and the second type—rational triads—consists of three mutually orthogonal alternating fields. In each case it can be shown through experiment and theory that the fluid vorticity vector is parallel to one of the three field components. For any given set of field frequencies this axis is invariant, but the sign and magnitude of the vorticity (at constant field strength) can be controlled by the phase angles of the alternating components and, at least for some symmetry-breaking rational fields, the direction of the dc field. In short, the locus of possible vorticity vectors is a one-dimensional set that is symmetric about zero and is along a field direction.

According to an embodiment of the present invention, continuous, three-dimensional control of the vorticity vector is possible by progressively transitioning the field symmetry by applying a dc bias along one of the principal axes. Such biased rational triads are a combination of symmetry-breaking rational fields and rational triads. A surprising aspect of these transitions is that the locus of possible vorticity vectors for any given field bias is extremely complex, encompassing all three spatial dimensions. As a result, the evolution of a vorticity vector as the dc bias is increased is complex, with large components occurring along unexpected directions. More remarkable are the elaborate vorticity vector orbits that occur when one or more of the field frequencies are detuned. These orbits provide the basis for highly effective mixing strategies wherein the vorticity axis periodically explores a range of orientations and magnitudes.

More specifically, applying a dc field parallel to a carefully chosen alternating component of an ac/ac/ac rational triad field can create a field-symmetry transition. By exploiting this transition, theory and experiment show that the vorticity vector can be oriented in a wide range of directions that comprise all three spatial dimensions. The direction of the vorticity vector can be controlled by the relative phases of the field components and the magnitude of the dc field. Detuning one or more field components to create phase modulation causes the vorticity vector to trace out complex orbits of a wide variety, creating very robust multiaxial stirring. This multiaxial, non-contact stirring is attractive for applications where the fluid volume has complex boundaries, or is congested. Multiaxial stirring can be an effective way to deal with the dead zones that can occur when stirring around a single axis and can eliminate the accumulation of particulates that frequently occurs in such mixing.

BRIEF DESCRIPTION OF THE DRAWINGS

The detailed description will refer to the following drawings, wherein like elements are referred to by like numbers.

FIG. 1*a* shows the field trajectory and its converse with zero dc bias (c=0 in Eq. 1). The $C_2$ symmetry axis (symmetric under rotation by 180°) of this rational triad is the y axis, which is the vorticity axis. The x and z axis are antisymmetric under a 180° rotation. FIG. 1*b* shows the field trajectory with a 50% dc bias (c=0.5) along the x axis and does not possess the symmetry of vorticity. FIG. 1*c* shows the field trajectory with a 100% dc bias (c=1), so the ac amplitude is zero. This is now a symmetry-breaking rational field and the z axis is the $C_2$ symmetry axis and the vorticity axis direction.

FIG. 8*a* shows the orbits for heterodyne transects parallel to transect four in FIG. 5. Changing from one orbit to another requires only a change of the phase on a signal generator. FIG. 8*b* shows the orbits for heterodyne transects parallel to the second transect in FIG. 5.

FIG. 14*b* shows the phase plot indicating strongly non-harmonic dynamics. For a harmonic oscillator this phase plot would be an ellipsoid.

DETAILED DESCRIPTION OF THE INVENTION

Figure 1A:
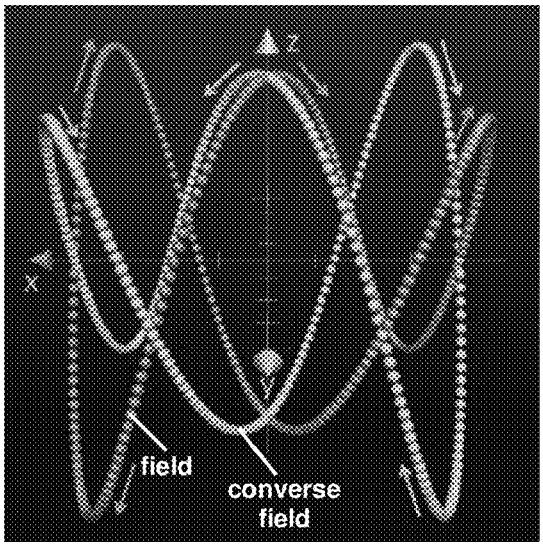
FIGS. 1*a*-1*c* illustrate the field symmetry transition for the 1+dc:2:3 triaxial field.

Mixing with triaxial magnetic fields has some unique and attractive characteristics. See J. E. Martin, *Phys. Rev. E*79, 011503 (2009); and J. E. Martin et al., *Phys. Rev. E* 80, 016312 (2009). Only a small volume fraction of magnetic particles is needed (~1-2 vol. %); only modest, uniform fields (~150 Oe) are required; the mixing torque is independent of field frequency and fluid viscosity (within limits); and the mixing torque is independent of particle size, making this technique suitable for use in a variety of systems ranging in size from the micro to industrial scale. Furthermore, the torque density is uniform throughout the fluid, creating a 'vortex fluid' capable of peculiar dynamics. Finally, unlike traditional magnetic stir bars, which can experience instabilities that result in fibrillation or stagnation, there are no such instabilities associated with this technique, making it a simple, robust means of creating non-contact mixing.

This approach to mixing can eliminate or reduce the fluid stagnation that can occur in conventional stirring, in which the stirring axis is stationary. Fluid stagnation is a problem in simple geometries, such as near the corners of a cylindrical volume, and is even worse in complex or obstructed volumes, such as those that occur in engineered microfluidic systems. See C. Gualtieri, "Numerical simulation of flow and tracer transport in a disinfection contact tank," Third Biennial Meeting: International Congress on Environmental Modeling and Software (iEMSs), 2006; and S. Suresh and S. Sundaramoorthy, in *Green Chemical Engineering: An introduction to catalysis, kinetics, and chemical processes*, CRC Press, USA 2014. Moreover, in a single-axis, rotary mixing scheme, the fluid flow profile is typically non-uniform and assumes the form of an irrotational vortex, wherein the fluid velocity is inversely proportional to the radial distance from the mixing axis. See S. Kay, in *An introduction to fluid mechanics and heat transfer,* $2^{nd}$ Ed., The Syndics of the Cambridge University Press, New York, USA, 1963.

The method of inducing flow in bulk liquids complements advances in liquid surface mixing using magnetic particles driven by an alternating magnetic field. See G. Kokot et al., *Soft Matter* 9, 6767 (2013); A. Snezhko, *J. Phys.: Cond. Mat.* 23, 153101 (2011); M. Belkin et al., *Phys. Rev. Lett.* 99, 158301 (2007); and M. Belkin et al., *Phys. Rev. E* 82, 015301 (2010). In the surface mixing method, the field organizes the particles into complex aggregations, such as "snakes," and the induced motion of these aggregations creates significant near-surface vorticity. These surface mixing techniques share an important similarity with the bulk mixing techniques: viscosity as a means of control. In the surface flow experiments increasing the viscosity causes a transition from the formation of "snakes" to the formation of "asters," which have less vigorous flow. See P. L. Piet et al., *Phys. Rev. Lett.* 110, 198001 (2013). When the liquid viscosity in the suspensions is increased, there is a transition from inducing vorticity to creating static particle aggregations.

Two methods have previously been discovered by the inventors of inducing fluid vorticity in magnetic particle suspensions. In the first method, two orthogonal ac components whose frequency ratio is a simple rational number are applied to the suspension. Vorticity is induced when an orthogonal dc field is applied, because this field creates the parity needed for deterministic vorticity. A theory of these symmetry-breaking fields has been developed that predicts the direction and sign of vorticity as functions of the frequencies and phase. See J. E. Martin and K. J. Solis, *Soft Matter* 10, 3993 (2014). The second method is based on rational triad fields, comprised of three orthogonal ac fields whose relative frequencies are rational numbers (e.g., 1:2:3). These fields also have the parity and symmetry required to induce deterministic vorticity and a symmetry theory has been developed that allows computation of the direction and sign of vorticity as functions of the frequencies and phases. See J. E. Martin and K. J. Solis, *Soft Matter* 11, 241 (2015).

According to an embodiment of the present invention, by progressively biasing one particular ac component of a rational triad to dc, competing symmetries can be generated that lead to a continuous reorientation of the vorticity vector, providing full three-dimensional control of fluid vorticity. Therefore, symmetry transitions between certain classes of alternating triaxial magnetic fields are used to produce time-dependent, non-contact, multi-axial stirring in fluids containing small volume fractions of magnetic particles. In this approach to mixing, the vorticity axis continuously changes its direction and magnitude, executing elaborate, periodic orbits through all three spatial dimensions. These orbits can be varied over a wide range by phase-modulating one or more field components, and a wide variety of orbits can be created by controlling the phase offset between the field components. This method provides an entirely new approach to efficient mixing and heat transfer in complex geometries.

The symmetry-transition method of the present invention is based on the observation that both ac/ac/dc (symmetry-breaking) and ac/ac/ac (rational triad) fields can generate fluid vorticity. The axis around which this vorticity occurs is the critical factor enabling field-symmetry-driven vorticity transitions.

For the symmetry-breaking ac/ac/dc fields the vorticity axis is determined by the reduced ratio l:m of the two ac frequencies. Because l and m are relatively prime then at least one of these numbers is odd. A consideration of the symmetry of the field trajectory and its equivalent converse jointly shows that if only one of these numbers is odd the vorticity is parallel to the odd field component and reversing the dc field reverses the vorticity. If both of these numbers are odd the vorticity is parallel to the dc field component. For odd:odd fields reversing the dc field direction does not reverse the flow, which suggests that for these fields the dc component can be replaced by an ac field and vorticity can still occur. In all cases, the sign and magnitude of the vorticity can be controlled by the phase angle between the two ac components. See J. E. Martin and K. J. Solis, *Soft Matter* 10, 3993 (2014).

For the fully alternating rational triads (ac/ac/ac), the direction of vorticity is controlled by the three relative field frequencies l:m:n, where l, m, and n are integers having no common factors. There are four classes of such fields: I) even:odd:odd; II) even:even:odd where even:even can be factored to even:odd; III) even:even:odd where even:even can be factored to odd:odd and; IV) odd:odd:odd. See J. E. Martin and K. J. Solis, *Soft Matter* 11, 241 (2015). By analyzing the symmetries of the 3-d Lissajous trajectories of the field and its converse jointly it is possible to show that the direction of vorticity is parallel to the field component that has unique numerical parity. The fourth class (odd:odd:odd) has no component with a unique numerical parity and so does not possess the symmetry required to predict a vorticity axis. However, off-axis vorticity exists in that case.

Consider now the possibility of creating a continuous symmetry transition by gradually transitioning one of the three ac field components of a rational triad into a dc field, while keeping the root-mean-square (rms) field amplitude constant. To be definite, let l, m, and n lie along the x, y, and z components, respectively. If it desired to transition the z component of the field to dc the relevant expression is $$H_0^{-1}H_0(t) = \sin(l\times 2\pi ft + \phi_l)\hat{x} + \sin(m\times 2\pi ft + \phi_m)\hat{y} + \left[\sqrt{1-c^2}\sin(n\times 2\pi ft + \phi_n) + \frac{c}{\sqrt{2}}\right]\hat{z} \quad (1)$$

where f is a characteristic frequency determined by the operator. Note that all three field components have equal rms values and the ac-to-dc transition is effected by increasing c from 0 to 1 or from 0 to −1. The z axis ac and dc fields have equal rms amplitudes when $c=1/\sqrt{2}$. The effect of this ac-dc transition on field symmetry depends on both the class of rational triad as well as the component that is transitioned.

Rational Triad with Even, Odd, Odd Fields

Consider the odd:even:odd field 1:2:3 for one particular set of phases. FIG. 1*a* shows the field trajectory and its converse with zero dc bias (c=0 in Eq. 1). For this class of fields the vorticity axis is along the even direction (e.g., relative field frequency m=2), which is the y axis in this case. If the y field component is continuously transitioned to dc the vorticity axis will remain in the y direction (see the symmetry-derived rules given above), so no reorientation of the vorticity axis is anticipated because field symmetry is preserved in this transition. In this particular case the sign of the final vorticity is independent of the sign of the dc field, but is dependent on the phase angles of the ac field components, so a vorticity-reversal transition should be possible wherein the fluid stagnates at some value of c.

Figure 1B:
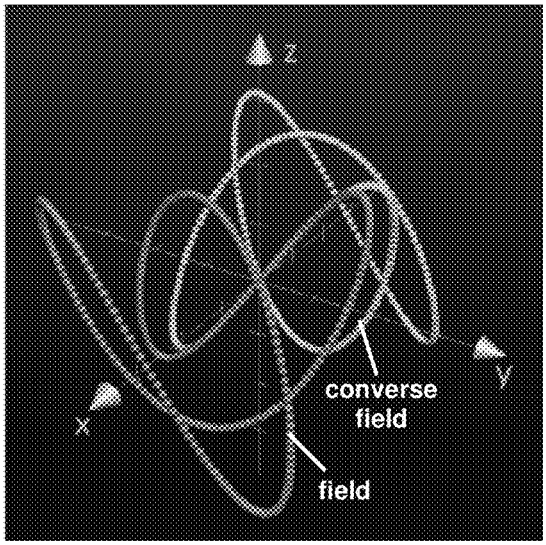
Figure 1C:
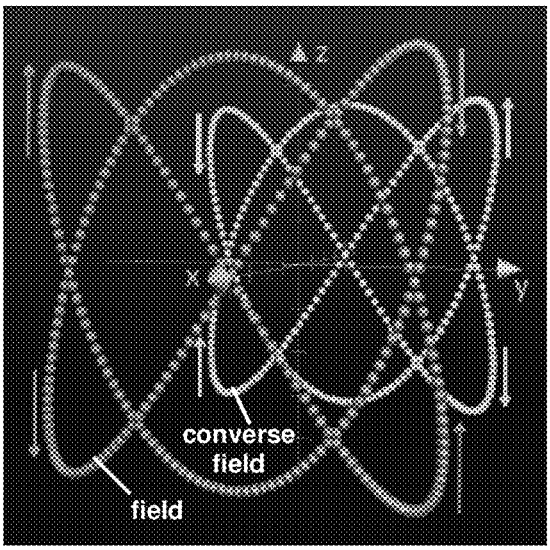

Transitioning either of the odd field components to dc is much more interesting. The x and z axis are antisymmetric under a 180° rotation. If the x component is fully transitioned to dc a change of field symmetry occurs that causes the vorticity vector to reorient from the y to the z axis. The progression of this symmetry change can be seen in FIGS. 1*b-c*. As shown in FIG. 1*b*, for intermediate values of the dc amplitude ($0<|c|<1$) the field trajectory and its converse field trajectory do not exhibit the symmetry of vorticity, but the continuous nature of the field transition suggests a continuous reorientation of the vorticity axis nevertheless: It would seem unphysical for the vorticity to abruptly change at some intermediate dc field amplitude. FIG. 1*c* shows the field trajectory with a 100% dc bias (c=1), so the ac amplitude is zero. This is now a symmetry-breaking rational field and the z axis is the $C_2$ symmetry axis (symmetric under rotation by 180°) and the vorticity axis direction. An interesting aspect of this particular field transition is that the final vorticity sign is dependent on the dc field direction. This means there are four possible vorticity axis transitions: one wherein the vorticity axis vector transitions from +y to +z, one from +y to −z, one from −y to −z, and one from −y to +z. It is reasonable to assume that the vorticity vector reorients in the y-z plane in all cases, but this is not the case and a strong vorticity component can emerge along the x axis for intermediate dc amplitudes. This unexpected out-of-plane vorticity is investigated below by using the torque density functional to compute the torque density for these fields.

The same considerations hold when the z component is continuously transitioned from ac to dc, only in this case the final vorticity axis is along x. The vorticity vector can thus be expected to orient anywhere in the x-y plane, but a strong contribution to the vorticity occurs around the z axis, which is surprising.

To summarize, for even, odd, odd fields applying a dc field along one odd ac component causes the vorticity to rotate from the even component direction to the other odd component. But applying a dc bias along the even component does not cause a change in the vorticity direction.

Rational Triad with Odd, Even, Even Fields where Even:Even Factors to Odd:Even The simplest field of this class is 1:2:4. For these fields the vorticity is around the odd axis (e.g., relative field frequency l=1), which is x in this case. As a result, if the y or z component of the field is transitioned to dc the direction of the vorticity axis will not change. The sign of the vorticity might change, however, because in this case it is dependent on the sign of the dc field. Thus a symmetry-driven transition that gives rise to flow reversal can be effected by a proper selection of the dc field sign.

If the x component transitions to dc, the vorticity axis will reorient from the x to the y axis, with the vorticity sign again dependent on the dc field sign. In this case it is expected that the vorticity vector can be continuously oriented in the x-y plane, but the torque density functional described below predicts a surprising component along the z axis during this transition. Therefore, applying a dc field along the odd component (i.e., the x axis in this case) will cause the vorticity to reorient from the odd field axis to the odd axis that arises from factoring even:even (i.e., the y axis is the odd axis that arises from factoring the remaining 2:4 fields to 1:2).

In summary, for odd, even, even fields applying a dc field along either even component will not change the orientation of the vorticity axis, but might cause it to reverse. Applying a dc field along the odd component will cause the vorticity to reorient from the odd field axis to the odd axis that arises from factoring even:even.

Rational Triad with Odd, Even, Even Fields where Even:Even Factors to Odd:Odd For this class of fields, such as 1:2:6, the vorticity is around the odd field axis, which in this case is again along x. If one ac component of such an odd:even:even field is fully transitioned to dc there are three possible outcomes: <u>dc</u>:odd:odd (i.e., the remaining 2:6 fields factor to 1:3), <u>odd</u>:dc:even, or <u>odd</u>:even:dc. In each case the symmetry rules show that the vorticity remains around the x axis (underlined). Therefore no change in the orientation of the vorticity axis is expected, though its sign and magnitude might change during the transition. In other words, such fields produce robust vorticity that is not strongly affected by stray dc fields. Note that only if the even field is transitioned does the final vorticity sign depend on the sign of the dc field.

Rational Triad with Odd:Odd:Odd Fields

The final case of odd:odd:odd (e.g., 1:3:5) fields is interesting, because any field component that is transitioned to dc becomes the vorticity axis. This suggests that applying a dominant dc field in any direction along any field component will induce vorticity around that component, enabling fine control of the vorticity direction.

Predictions from the Torque Density Functional

A measure of the torque density produced in a magnetic particle suspension subjected to a triaxial field has previously been proposed that is based on both theory and experiment. See J. E. Martin and K. J. Solis, *Soft Matter* (2015). This functional was found to conform to all of the predictions of the symmetry theories but can also be applied to those cases where the trajectories of the triaxial fields do not possess the symmetry of vorticity, such as the field-symmetry-driven vorticity transitions of the present invention. This functional also makes useful quantitative predictions for the amplitude of the torque density as a function of field frequencies and phases. The functional is given by $$J_{\{\phi\}} = \int_0^1 J_{\{\phi\}}(s)\,ds \text{ where } J_{\{\phi\}}(s) = |h(s)|^2 \frac{h(s)\times\dot{h}(s)}{|h(s)\times\dot{h}(s)|} \tag{2}$$

where the dependence on the phase angles is indicated. Here $J_{\{\phi\}}(s)$ is the instantaneous torque density, $h(s)=H_0^{-1}H_0(s)$ is the reduced field, and $s=ft$ is the reduced time in terms of the characteristic field frequency in Eq. 1. The experimentally measured, time-average torque density is related to this functional by $T_{\{\phi\}}=\text{const}\times\varphi_p\mu_0H_0^2J_{\{\phi\}}$, where $\mu_0$ is the vacuum permeability and $\varphi_p$ is the particle volume fraction.

Before giving the predictions of the torque density functional it is informative to consider what one might reasonably expect to occur. Returning to the example case of a 1+dc:2:3 field, for zero dc field the vorticity is parallel to the y axis (along the "2" field component) and for the full dc case, dc:2:3, it is parallel to the z axis, both in accordance with symmetry theory. For intermediate values of c a simple 'rule of mixing' consistent with a field-squared effect is $$J_{\{\phi\}}(c)=(1-c^2)|J_{\{\phi\}}(0)|\hat{y}+c^2|J_{\{\phi\}}(1)|\hat{z}. \tag{3}$$

This expression confines the vorticity vector to the y-z plane, which seems reasonable, but how does this expression compare to the predictions of Eq. 2? It is clear that inserting Eq. 1 into Eq. 2 does not result in an expression in which the ac and dc terms are separable, but it is not clear how important this is.

Predicted Torque Densities Along the Three Field Components

Figure 2A:
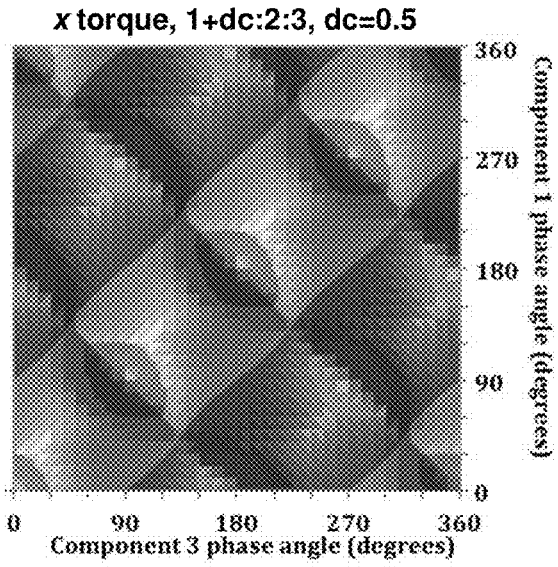
FIGS. 2*a*-2*c* show the predicted torque components along all three axes for a 1+dc:2:3 field with a c=0.5.
Figure 2B:
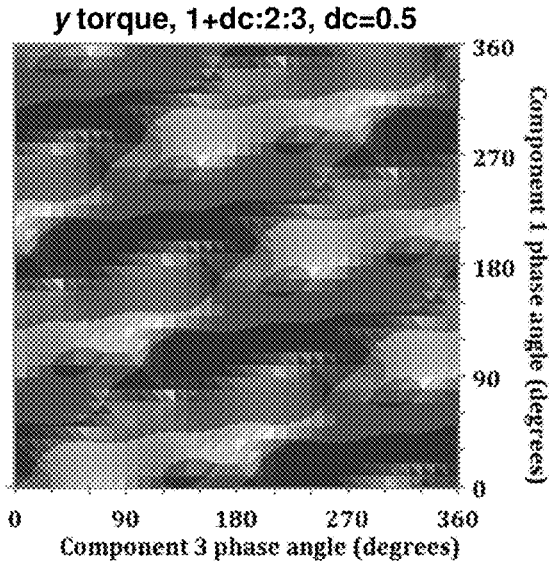
Figure 2C:
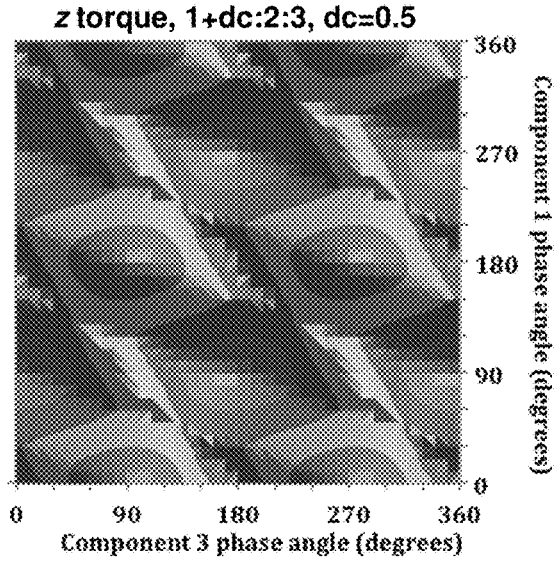

To obtain an appreciation for the complexity of this symmetry transition, in FIGS. 2*a*-2*c* are plotted components of the torque density computed from Eq. 2 as functions of the phase angles $\phi_1$ and $\phi_3$ for c=0.5. It is surprising to see that there is a component along the x axis (FIG. 2*a*), and in fact this is the dominant component, with a maximum value of 0.16 (arb. units) as compared to 0.09 for the y axis (FIG. 2*b*) and 0.12 for the z axis (FIG. 2*c*).

Figure 3A:
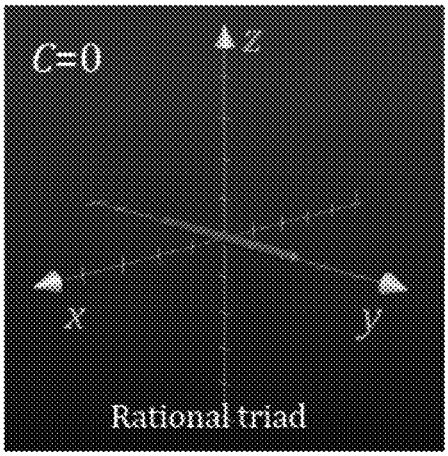
FIGS. 3*a*-3*f* illustrate the nature of the continuous vorticity transition from the rational triad 1:2:3 to the symmetry-breaking rational field dc:2:3. These data are the computed torque functional, Eq. 2, for a square lattice of points in the $\phi_1$-$\phi_3$ plane in FIG. 2, separated by 10° along each cardinal direction. For the rational triad (c=0) the computed torque vectors are along the y axis (FIG. 3*a*), so changing the phase angles merely changes the magnitude. When a dc bias is applied along the x axis the torque vectors fairly explode off the y axis to have significant components along both the x and z axes (FIGS. 3*b*-3*d*), so changing the phase angles now enables a change in both the magnitude and direction of the fluid vorticity. As the dc field increases, this cloud of torque density data expands into a shape reminiscent of a pendulum ride (FIG. 3*e*), finally collapsing onto the z axis (FIG. 3*f*) when the field along the x axis no longer contains an ac component: this is the symmetry-breaking-field limit, where c=1. Field biasing thus enables continuous control over the direction of the vorticity direction. The tick marks on all axes are separated by 0.025.
Figure 3B:
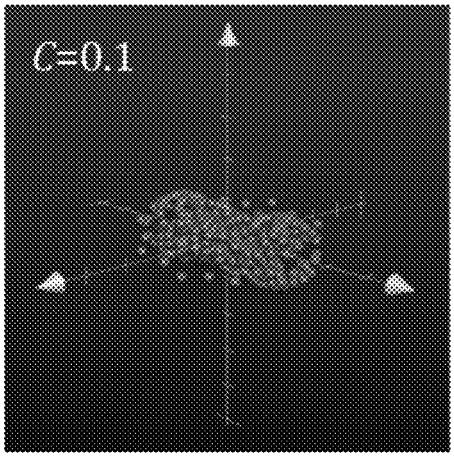
Figure 3C:
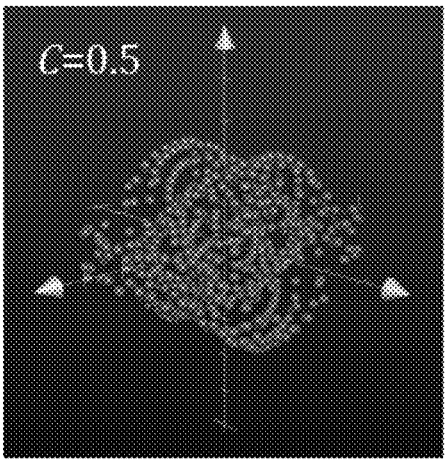
Figure 3D:
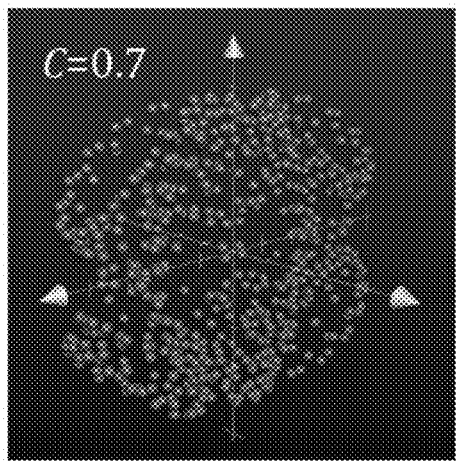
Figure 3E:
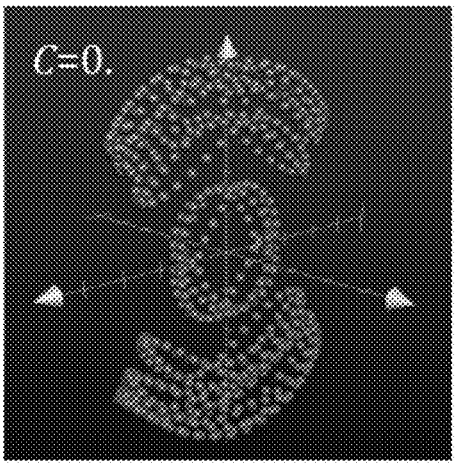
Figure 3F:
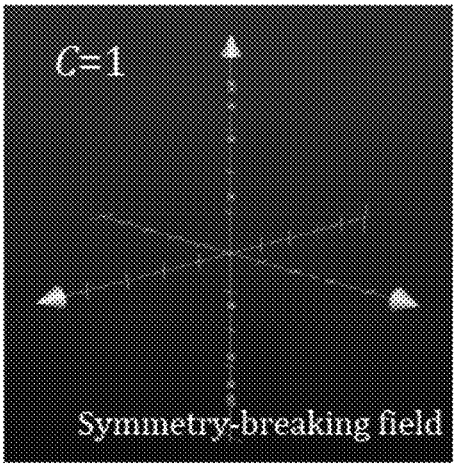
Figure 4A:
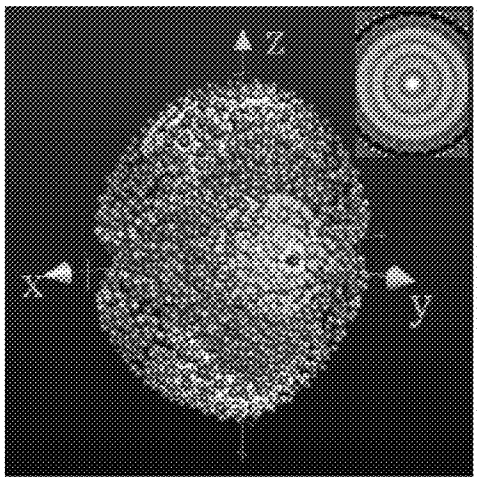
FIGS. 4*a*-4*d* present the data in FIG. 3, along with other values of the relative dc field amplitude, so that the full range of vorticity control can be appreciated. The maximum torque density amplitude in the x direction is roughly equal to that of the z direction. Inset is a mandala that seems to capture the appearance of the data.
Figure 4B:
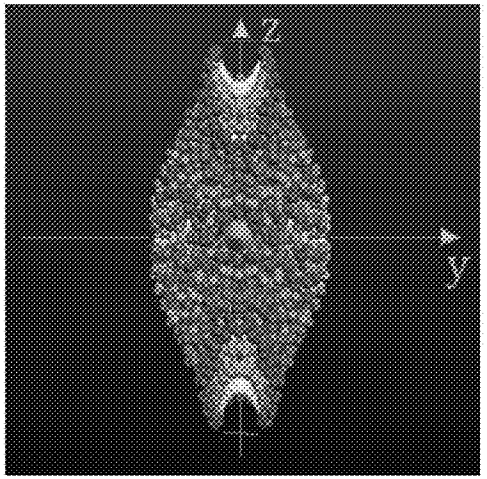
Figure 4C:
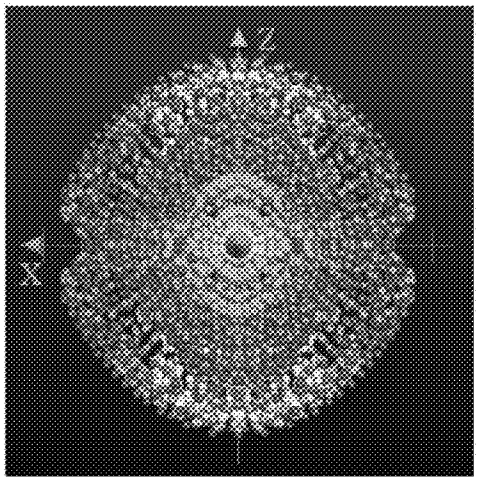
Figure 4D:
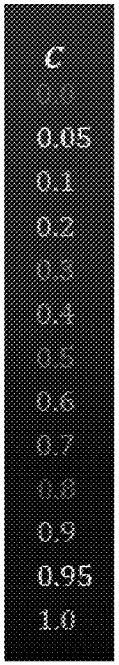
Figure 4D:
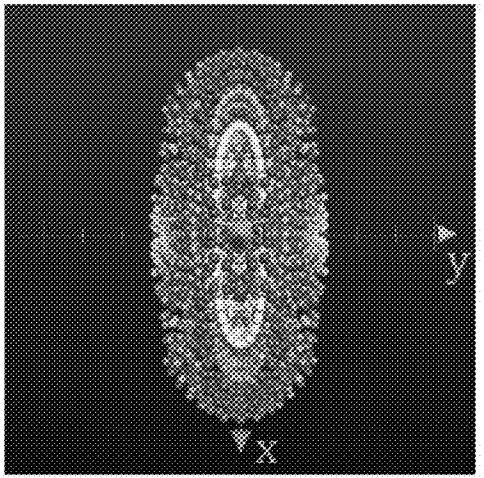

One aspect of the nature of the vorticity transition from the rational triad 1:2:3 to the symmetry-breaking rational field dc:2:3 is illustrated in FIGS. 3*a*-3*f*, which shows the torque density for each point of a square lattice of points in the $\phi_1$-$\phi_3$ plane, separated by 10° along each cardinal direction. As shown in FIG. 3*a*, for the rational triad (c=0) the computed torque vectors are along the y axis, so changing the phase angles merely changes the magnitude and sign of the vorticity. But even when a small dc bias is applied along the x axis, the torque vectors have comparable components along both the x and z axes, as shown in FIG. 3*b*. Changing the phase angles thus enables a change in both the magnitude and direction of the fluid vorticity through all three dimensions. As the dc field increases, the locus of the torque densities expands, eventually attaining a shape reminiscent of a pendulum ride at a fair, as shown in FIG. 3*e*. As shown in FIG. 3*f*, the locus finally collapses onto the z axis when the field along the x axis no longer contains an ac component: this is the symmetry-breaking-field limit, where c=1.

The full range of three-dimensional control of the torque density is given in FIGS. 4*a*-4*d*, where torque density data for numerous values of the dc bias are plotted, again for the square lattice of phase angles referred to in FIG. 3. The torque density has significant components in the x and z directions and by proper selection of the dc bias and phase angles vorticity can be created along essentially any direction. This complex set of vorticity vectors has implications for non-stationary flow, as will be described below.

Figure 5:
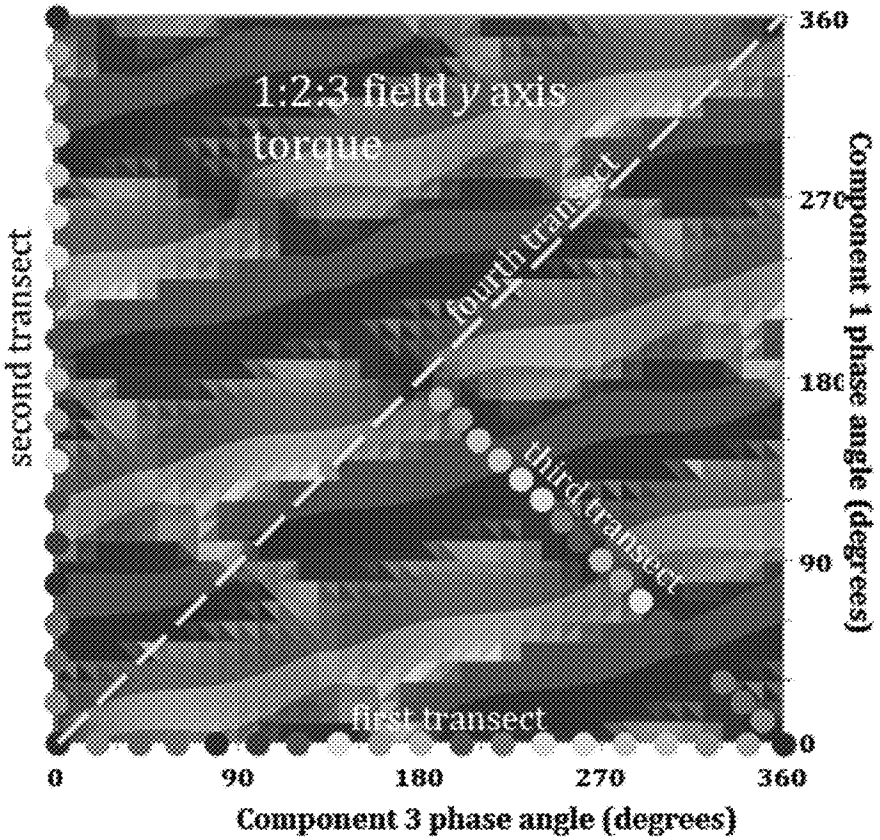
FIG. 5 shows the torque component along y for a 1:2:3 field along with the color keys for the first, second, and third transects used to generate FIGS. 6*a*-6*d*.

It is interesting to determine how the torque density produced at any given pair of phase angles evolves as the dc bias is progressively increased. FIG. 5 shows the phase angles along the first three transects. This figure serves as the color key for the curves in FIGS. 6*a*-6*d*. Each of these curves must start on the y axis and terminate on the z axis.

Figure 6A:
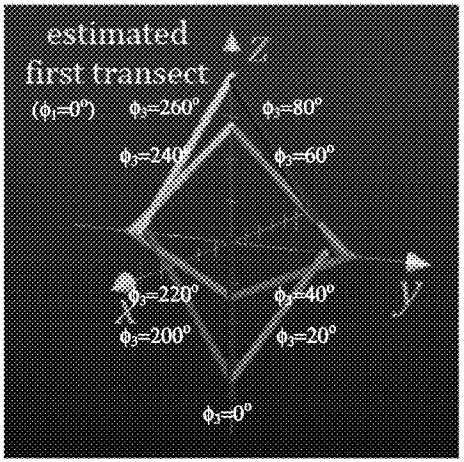
FIG. 6*a* shows the result of using Eq. 3 to estimate the torque density during the transition from 1:2:3 to dc:2:3. Each line represents a different set of phase angles along the first transect shown in FIG. 5. For this transect $\phi_1$=0° and $\phi_3$ increases from 0° to 360° by intervals of 20°. Not all colors in the key are shown because certain phase angles give the same curves. Equivalent $\phi_3$ angles are (90°+n, 90°−n) and (270°+n, 270°−n) where 0°≤n≤90°. Data are for 0≤c≤1 in intervals of 0.01. The torques start on the y axis and end on the z axis and are confined to the y-z plane. The tick marks on all axes are separated by 0.025.

In FIG. 6*a* is shown the result of using the simple mixing law of Eq. 3 to estimate the torque density during the field symmetry transition from 1:2:3 to dc:2:3. The only inputs into this mixing law are the computed y axis torque densities for c=0 and the z axis torque densities for c=1. Here each line represents a different pair of phase angles along the first transect shown in FIG. 5. For this first transect $\phi_1$=0° and $\phi_3$ increases from 0° to 360° by intervals of 20°. Not all colors in the key are shown because certain phase angles give the same curves when this mixing law is used. Equivalent $\phi_3$ angles are (90°+n, 90°−n) and (270°+n, 270°−n) where 0° 90°. Data are for 0≤c≤1 in intervals of 0.01. As indicated by the straight lines in FIG. 6*a*, this mixing law predicts that the torques are confined to the y-z plane.

Figure 6B:
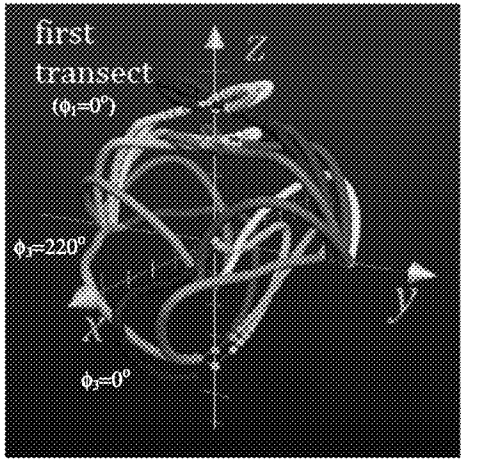
As shown in FIG. 6*b*, when the torque functional in Eq. 2 is used to predict the torque density for points along the first transect the result is dramatically different than the simple rule of mixing. All the colors in the key in FIG. 5 are shown because each point gives a unique curve. These torque curves have substantial deviations from the y-z plane: in some cases the x torque is dominant. If the dc field is reversed (0≥c≥1) both the x and the z components of the torque are reversed.
Figure 6C:
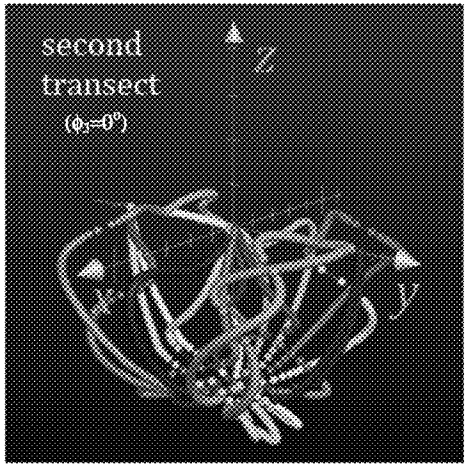
FIGS. 6*c* and 6*d* show torque functional calculations for points along the second and third transects during the transition from 1:2:3 to dc:2:3. The key for the colors is given in FIG. 5. Again, in some cases the x torque dominates. If the dc field component is reversed (0≥c≥1) both the x and the z components of the torque are reversed, which would fill out the upper hemisphere for second transect, but do nothing for the third transect.
Figure 6D:
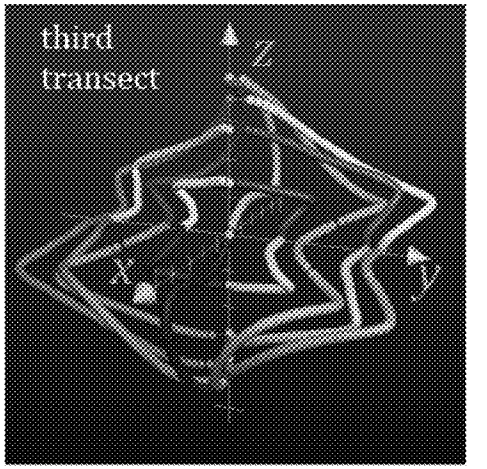

However, the behavior predicted by the torque functional is much richer than that predicted by the simple mixing law. When the functional in Eq. 2 is used to predict the torque density the result is dramatically different. In FIG. 6*b* are shown computations for the phase angles along the first transect. All the colors in the key in FIG. 5 are now shown because each pair of phase angles produces a unique curve. These torque density curves have substantial deviations from the y-z plane and in some cases the x torque component even dominates. In all cases if the dc field is reversed (0≥c≥1) both the x and the z torque components are reversed, which constitutes a rotation by 180° around the y axis. Torque density calculations for points along the second and third transects are also given in FIGS. 6*c* and 6*d*. Once again, the x component of the torque often dominates. Reversing the dc field (0≥c≥1) would fill out the upper hemisphere for torque densities along the second transect, but would do nothing along the third transect. In general, increasing the dc bias is expected to produce a complex evolution of the vorticity.

Prediction of Vorticity Orbits

Figure 7A:
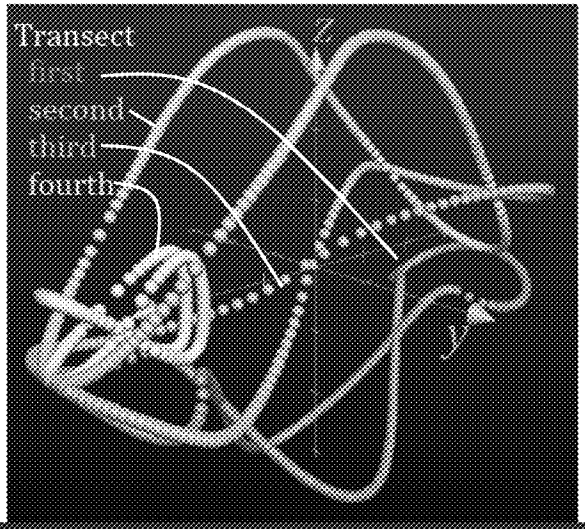
FIGS. 7*a* and 7*b* show that field heterodyning produces strange vorticity orbits. In this case the heterodyne paths are simply along the transects shown in FIG. 5. Along the first transect only the z component frequency is detuned and along the second transect only the x field component is detuned. For the third transect both the x and z components are detuned by equal and opposite amounts. For the fourth transect the x and z components are detuned by equal amounts. This heterodyning produces persistent vorticity of ever-changing direction, except for along the third transect, where the torque density does vanish. Along the fourth transect heterodyning accomplishes little. These orbits were computed for the case where the rms ac and dc components are equal, c=0.5.
Figure 7B:
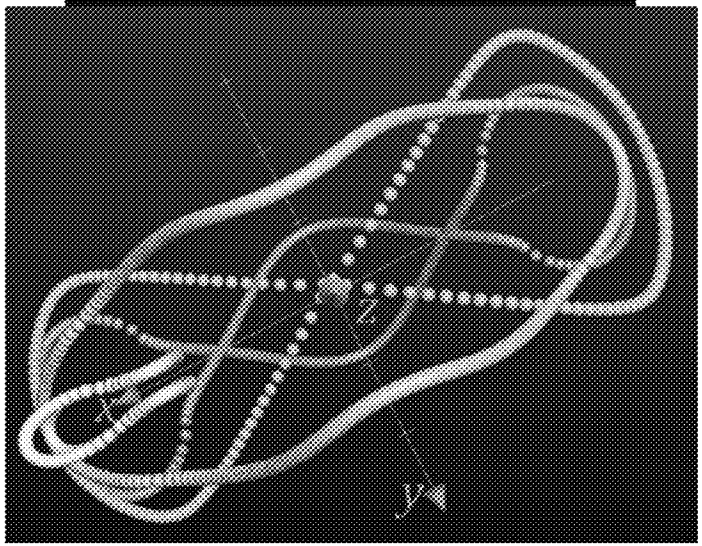

Phase modulating components of the applied 1+dc:2:3 field produces a rich variety of vorticity orbits that are both interesting and potentially useful for a number of applications. These orbits have been numerically investigated for the dc bias c=0.5. In FIGS. 7*a* and 7*b* are shown the simplest possible vorticity orbits, taken along the four transects shown in FIG. 5. In the laboratory the first transect would be realized by slightly detuning the field frequency along the z axis. The second transect would be obtained by detuning the frequency of the x component. The third transect requires detuning both of these field components by equal and opposite amounts, and for the fourth transect by equal amounts.

The fourth transect is a bit of a disappointment, as the torque density barely changes, but the other transects produce striking results. The first and second transects produce orbits with a net torque around the z axis (averaged over one orbital cycle) but with zero net torques around the other axes. For these orbits the mixing is persistent. The orbit for the third transect is interesting in that it produces zero net torque around any of the principal axes, which would enable complex mixing in freestanding droplets without incurring any net migration of the droplet. This mixing strategy would be ideal for the development of parallel bioassays of container-less droplet arrays, perhaps comprised of millions of droplets. The fourth transect produces a non-zero net torque around the x axis alone.

Figure 8B:
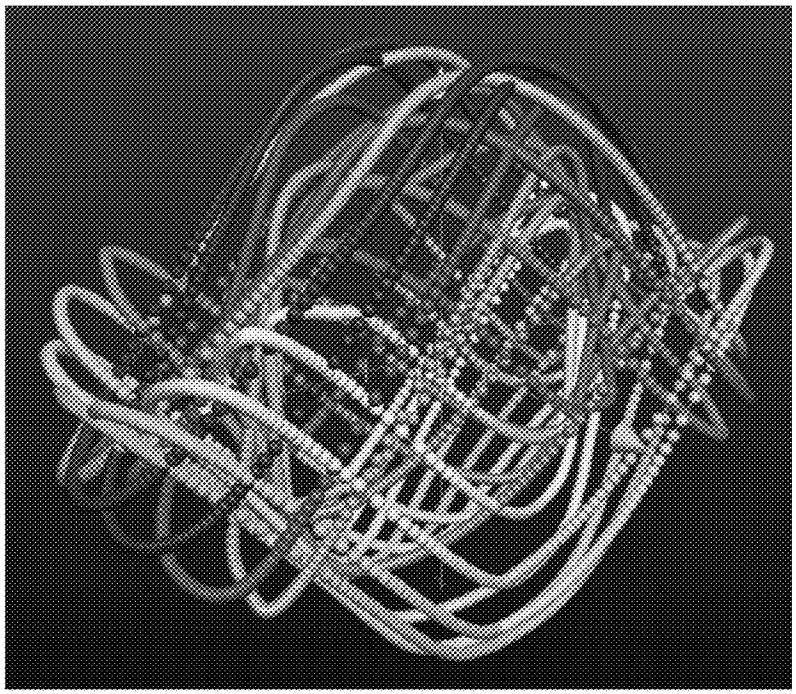
FIGS. 8*a* and 8*b* show that the heterodyne orbits are sensitive to the relative phase, which provides a simple means of orbit control.
Figure 8A:
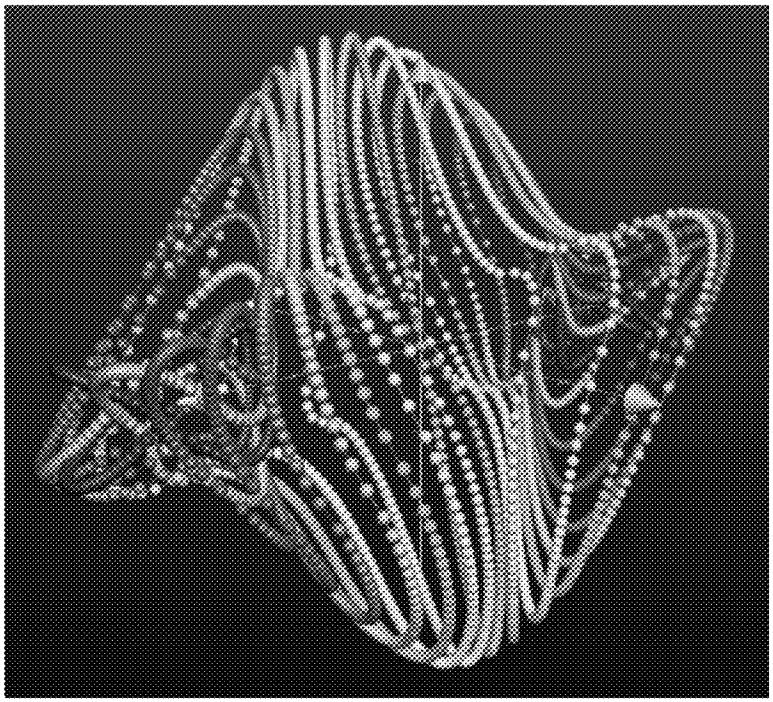
Figure 9A:
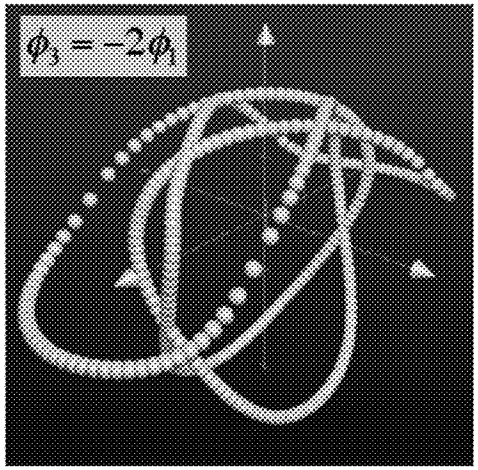
FIGS. 9*a*-9*d* show the elaborate vorticity vector orbits that occur when the field components are detuned by different amounts. The figures are for four simple cases that arise when the x and z field components are detuned by a ratio of 2:1. Adding a constant phase shift to either field component will alter these orbits. Therefore, heterodyning can produce complex variations in the magnitude and direction of the vorticity vector.
Figure 9B:
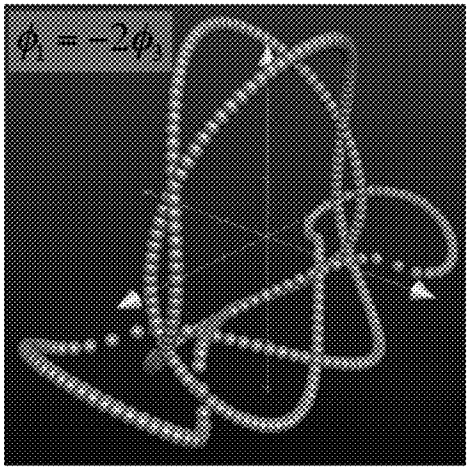
Figure 9C:
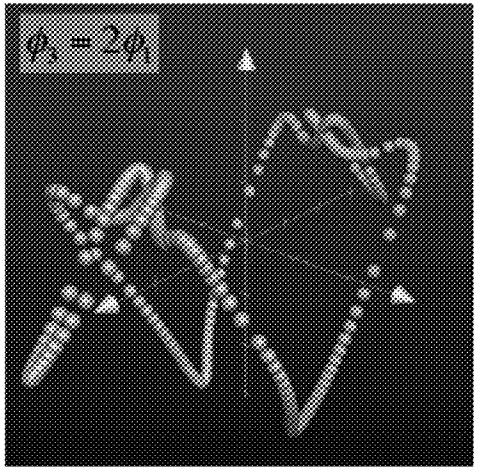
Figure 9D:
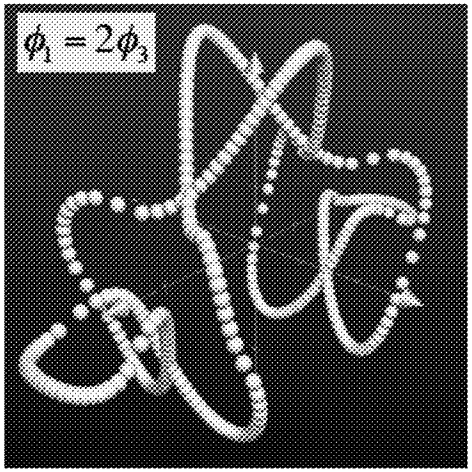

The phenomenology of these vorticity orbits is much richer than indicated. FIGS. 8*a* and 8*b* show the effect of adding a phase offset to one of the field components, in this case the x component, to create transects that are parallel to those already discussed. FIG. 8*a* shows a family of orbits obtained by transects parallel to the fourth transect in FIG. 5. This set of orbits was obtained by adding phases from 0-180° in increments of 10°. The rather confined vorticity orbit for the fourth transect in FIG. 7*a* grows into large orbits and finally collapses back into the tiny fish-shaped orbit at a phase shift of 180°, but reflected in the y-z plane.

The same phase shifts were used to generate a set of orbits for a set of transects parallel to the second transect, generating the set of widely varying vorticity orbits in FIG. 8*b*. Adjustment of the relative phase enables a great deal of control over the dynamics of the vorticity vector induced by biased rational triad fields.

Finally, vorticity orbits for a few cases were investigated where the field frequencies along the x and z axes are detuned by unequal amounts, specifically by 2:1. These orbits, shown in FIGS. 9*a*-9*d*, are really elaborate. Additional complexity would emerge if phase shifts were applied to these transects.

Experimental Set Up

The magnetic particle suspension consisted of molybdenum-Permalloy platelets ~50 μm across by 0.4 μm thick dispersed into isopropyl alcohol at a low volume fraction.

For the 1:2:3 rational triad field, the fundamental frequency was 36 Hz (f in Eq. 1) and all three field components were 150 Oe (rms). The spatially uniform triaxial ac magnetic fields were produced by three orthogonally-nested Helmholtz coils. Two of these were operated in series resonance with computer-controlled fractal capacitor banks. See J. E. Martin, *Rev. Sci. Instrum.* 84, 094704 (2013). The third coil was driven directly in voltage mode by an operational power supply/amplifier. The phase shift of this coil at its operational frequency of 36 Hz was measured as +68° with a precision LCR meter. To compensate for this phase shift, this phase was added to the signal that drives the amplifier.

The signals for the three field components were produced by phase-locked via two function generators, allowing for stable and accurate control of the phase angle of each field component. Note that if these signals are simply produced from separate signal generators there will be a very slow phase modulation between the components due to the finite difference in the oscillator frequency of each function generator. And simply running two separate signal generators off the same oscillator does not control their phase relation. All of the measurements are strongly dependent on phase.

To quantify the magnitude of the vorticity, the torque density of the suspension was computed from measured angular displacements on a custom-built torsion balance. In this case the suspension (1.5 vol %) was contained in a small vial (1.8 mL) attached at the end of the torsion balance and suspended into the central cavity of the Helmholtz coils via a 96.0 cm-long, 0.75 mm-diameter nylon fiber with a torsion constant of ~13 mN·m rad$^{-1}$.

Locus of Torque Density Vectors

Figure 10A:
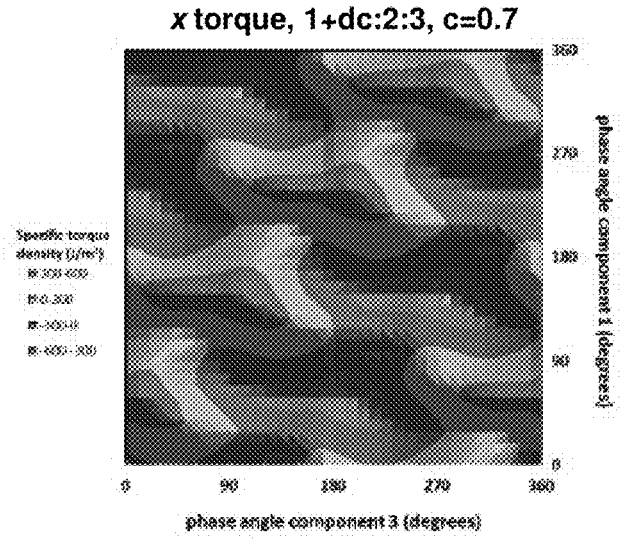
FIGS. 10*a*-10*c* show the experimental torque density plots for the x (FIG. 10*a*), y (FIG. 10*b*) and z (FIG. 10*c*) torque components. These data are for the 1:2:3 field with c=0.7.
Figure 10B:
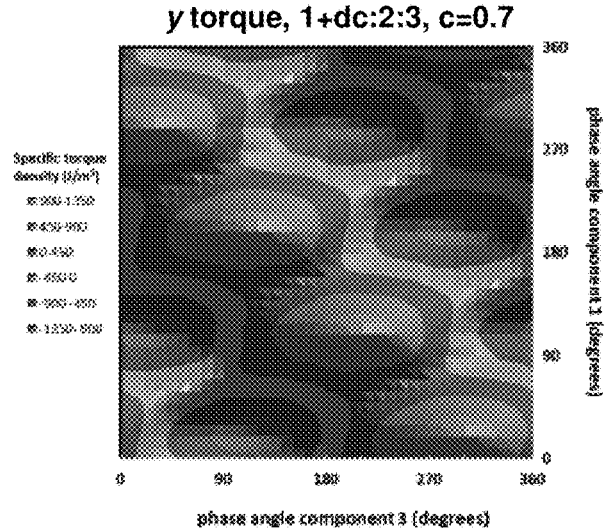
Figure 10C:
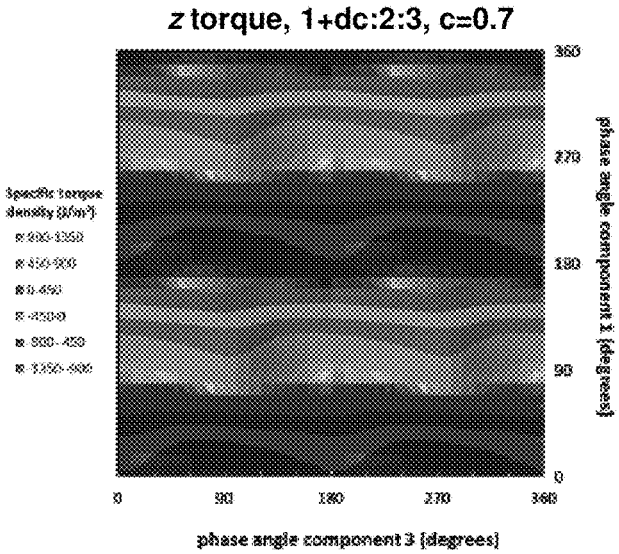

All of the above predictions depend on one key point: the appearance of torque along the x axis when a dc field is applied parallel to this axis. Recall that this torque does not exist for c=0 or 1, but is only expected for intermediate values, i.e. during the symmetry transition. In fact, upon the application of the dc bias this torque does appear, and is strong. FIGS. 10*a*-10*c* show the measured torque density along each of the three field components for the 1+dc:2:3 biased triaxial field with c=0.7, where both the ac and dc contributions of the biased field component have equal rms amplitudes. These experimental data were taken for a square lattice of points in the phase angle plane of FIG. 5 on 10° intervals, so in each of these three plots there are 36×36=1296 data points. However, the symmetry of the data reduces the required number of measurements for each plot to a fourth of this, 324.

Figure 11B:
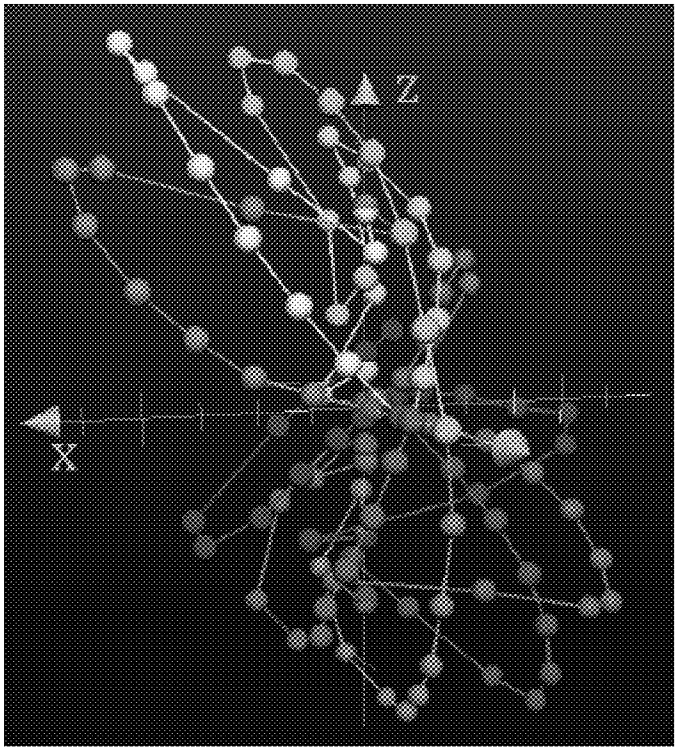
FIG. 11*b* shows the evolution of the vorticity vectors taken along the third transect as c is increased from 0 to 1. Each colored curve is for a different set of phase angles. Each curve starts on the y axis and terminates on the z axis. The important feature is the large torque density amplitude along the x axis.
Figure 11A:
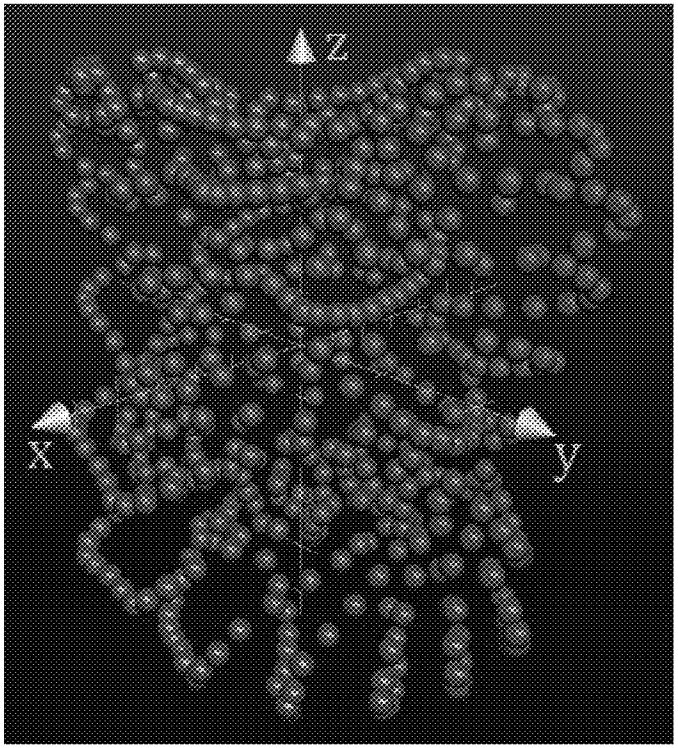
FIG. 11*a* shows the locus of possible vorticity vectors for the 1+dc:2:3 biased rational triad with c=0.7. These points span all three spatial dimensions, indicating that complex vorticity orbits can exist.

The set of measured vorticity vectors is plotted in FIG. 11*a*. These data can be compared to the computed data for the corresponding value of c=0.7 in FIG. 3*d*. The detailed appearance is different, but the essential point is that the locus of points does not simply lie in the y-z plane, but has significant components along the x axis. In fact, the maximum specific torque density (torque density divided by the volume fraction of particles) along the x axis is 476 J·m$^{-3}$, which can be compared to the maxima of 1127 and 993 J·m$^{-3}$ along the y and z axes, respectively. These torque maxima were obtained for a balanced 1+dc:2:3 biased triad with c=0.7, where each field component had equal rms amplitudes. Also, only the dc field amplitude was varied (at fixed ac field amplitudes corresponding to c=0.7) to see if this had any effect on the torque maxima. The torque maximum along the y axis is maximized for a dc field corresponding to c=0.7, but the x and z axis torques increased modestly to 602 and 1215 J·m$^{-3}$ by decreasing the dc field by ~33% and 24% respectively. Phase modulating can be expected to create three-dimensional orbits that intersect these points.

The progression of the measured torque density as the dc field is increased from c=0 to 1 is shown in FIG. 11*b* for points taken along the third transect of FIG. 5, but with a phase offset of +60° applied to the x axis (36 Hz) component, to ensure a significant torque density around this axis [see FIG. 10*a*]. These curves start on the y axis and terminate on the z axis and although they differ from the computed curves for the third transect, FIG. 6*d*, they do share the characteristic of being symmetric under a 180° rotation around the y axis. Again, the essential point is that these curves are substantially different than the reasonable prediction given in Eq. 3 in that they are not confined to the y-z plane.

Vorticity Orbits

Figure 12A:
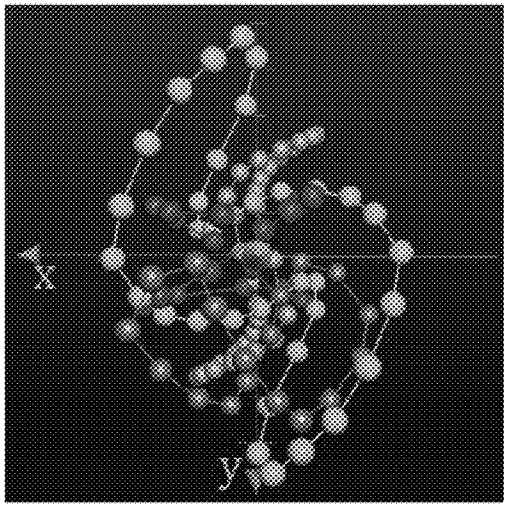
FIGS. 12*a*-12*c* show the experimental vorticity orbits along the four transects shown in FIG. 5 as viewed along each field component. Transect one is depicted in orange, transect two in green, transect three in violet, transect four in red. When averaged over a cycle, transects one and two have a net z axis vorticity, transect four has a net x axis vorticity, and transect three has a net y axis vorticity, in concurrence with the predictions from the torque density functional in FIG. 7.
Figure 12B:
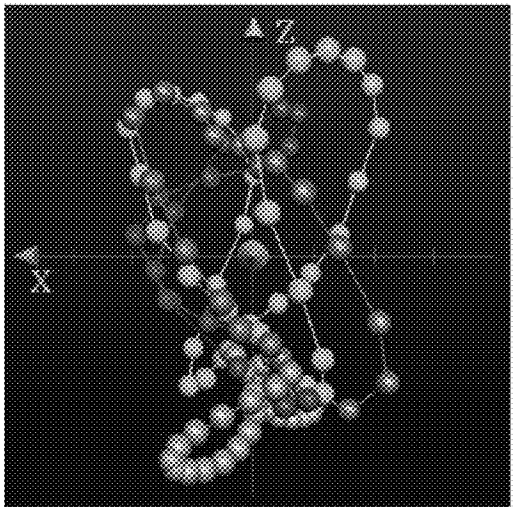
Figure 12C:
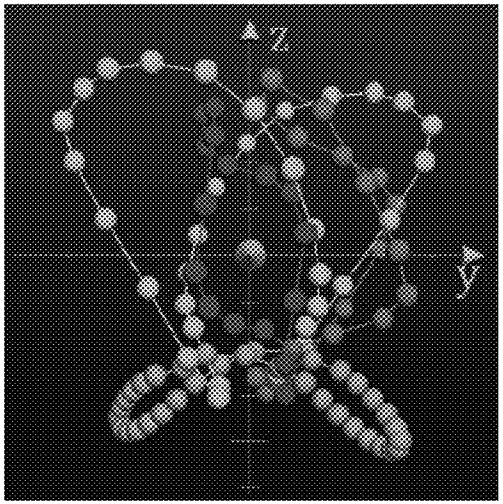
Figure 13A:
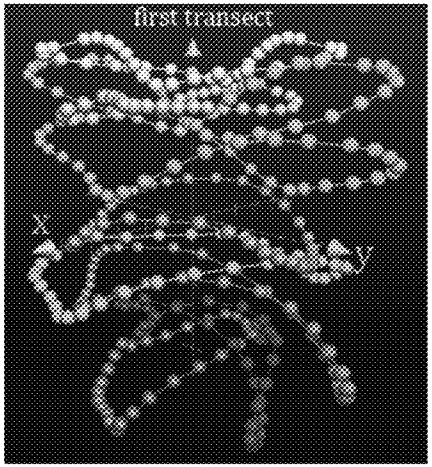
FIGS. 13*a*-13*d* show that the phase offsets significantly alter the vorticity orbits for each of the four transects shown in FIGS. 12*a*-12*c*. For each transect, curves are presented for successive parallel transects at 20° intervals.
Figure 13B:
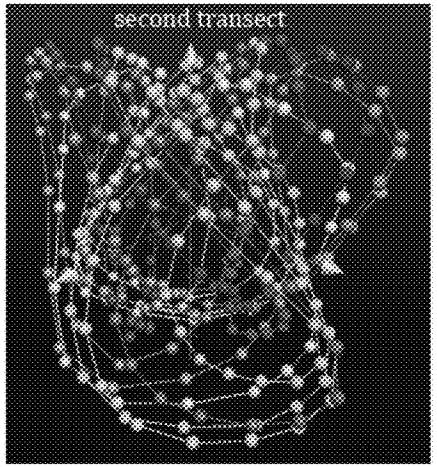
Figure 13C:
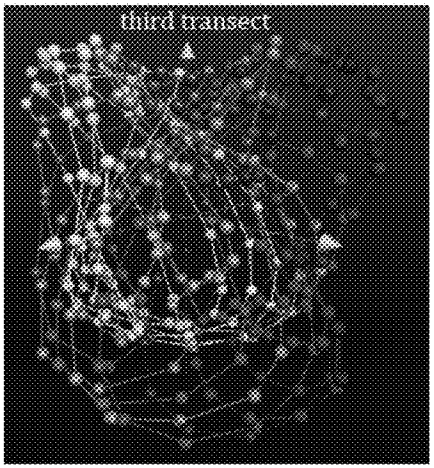
Figure 13D:
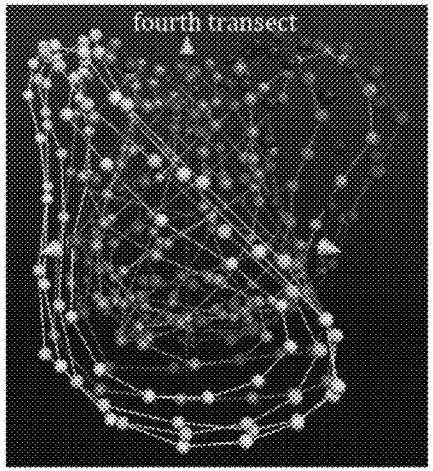

The vorticity orbits can be obtained by detuning one or more field components. To be clear about the experimental parameters the field can be written $$H_0^{-1}H_0(t) = \sin(2\pi(f_1+\Delta f_1)t+\phi_1)\hat{x}+\sin(2\pi f_2)\hat{y}+\frac{1}{\sqrt{2}}\left[\sin(2\pi(f_3+\Delta f_3)t)+\frac{1}{\sqrt{2}}\right]\hat{z}$$

where $f_1$=f, $f_2$=2f, and $f_3$=3f. The parameters $\Delta f_1$ and $\Delta f_3$ have been included to indicate detuning of the first and third field components. The principal vorticity orbits for the 1+dc:2:3 field, in FIGS. 12*a*-12*c*, are for zero offset phase, i.e. $\phi_1$=0, and correspond to the four transects in FIG. 5, which are $\Delta f_1$=0, $\Delta f_3$=const; $\Delta f_1$=const, $\Delta f_3$=0; $\Delta f_3$=$-\Delta f_1$; and $\Delta f_3$=$\Delta f_1$, respectively. In FIGS. 13*a*-13*d* are shown the families of orbits that emerge when the offset phase is increased from 0 to 340° by 20° intervals. Note that many of the points are the same in these plots (since they must be comprised of the available data points in FIGS. 11*a* and 11*b*), but the orbits interconnect these points in different ways.

Figure 14A:
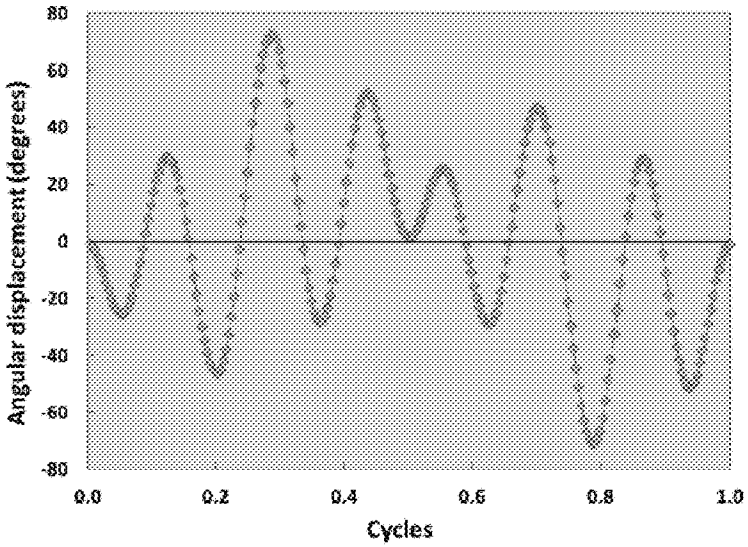
FIG. 14*a* is a plot of the x axis torque as a function of cycles for the phase modulated 1+dc:2:3 with c=0.7, given by the frequencies 36.1, 72 and 108.2 Hz.
Figure 14B:
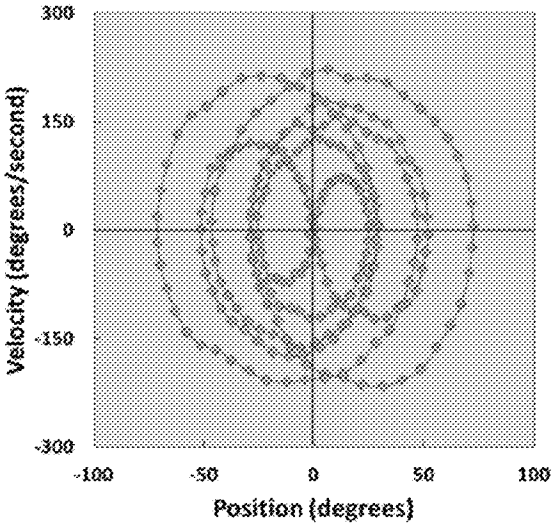
FIG. 14*b* shows the x axis torque plotted versus the time derivative of the torque to make a phase plot. The torque is periodic, though not a simple sinusoid.

The complexity of these orbits can be appreciated by one single phase modulation example, wherein the x component of the torque was monitored for the frequencies 36.1, 72, and 108.2 Hz and recorded the torque density as a function of time. The time dependence of this single component of the vorticity orbit is plotted in FIG. 14*a*, which shows a periodic behavior that is not a simple sinusoid. The phase plot in FIG. 14*b* shows strongly non-harmonic dynamics, since harmonic dynamics yield an ellipse. For this particular circumstance the variations in the torque density are symmetric about zero, indicating zero time-averaged vorticity, but there are many phase modulation cases where the vorticity never changes sign. In general, the phase plots can be very complex.

The present invention has been described as a method of multi-axis non-contact mixing of magnetic particle suspensions. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A method for non-contact mixing a suspension of magnetic particles, comprising:

providing a fluidic suspension of magnetic particles;

applying a triaxial magnetic field to the fluidic suspension, the triaxial magnetic field comprising three mutually orthogonal magnetic field components, at least two of which are ac magnetic field components wherein the frequency ratios of the at least two ac magnetic field components are rational numbers, thereby establishing vorticity in the fluidic suspension having an initial vorticity axis parallel to one of the mutually orthogonal magnetic field components; and progressively transitioning a symmetry of the triaxial magnetic field to a different symmetry, thereby causing the vorticity axis to reorient from the initial vorticity axis to a vorticity axis parallel to a different mutually orthogonal magnetic field component.

2. The method of claim 1, wherein a volume fraction of magnetic particles is greater than 0 volume % and less than 64 volume %.

3. The method of claim 1, wherein the magnetic particles are spherical, acicular, platelet or irregular in form.

4. The method of claim 1, wherein the magnetic particles are suspended in a Newtonian or non-Newtonian fluid or suspension that enables vorticity to occur at an operating field strength of the triaxial magnet.

5. The method of claim 1, wherein the strength of each of the magnetic field components is greater than 5 Oe.

6. The method of claim 1, wherein the frequencies of the at least two ac field components is between 5 and 10000 Hz.

7. The method of claim 1, further comprising detuning the ac frequency along at least one of the ac magnetic field components.

8. The method of claim 1, further comprising adjusting the relative phase of at least one of the ac magnetic field components.

9. The method of claim 1, wherein the triaxial magnetic field comprises three mutually orthogonal ac magnetic field components, thereby establishing vorticity in the fluidic suspension having an initial vorticity axis parallel to one of the ac magnetic field components; and wherein progressively transitioning the symmetry of the triaxial magnetic field comprises progressively replacing one of the three mutually orthogonal ac magnetic field components with a dc magnetic field component.

10. The method of claim 9, wherein the three ac magnetic field components have different relative ac frequencies l, m, and n, wherein l, m, and n are integers having no common factors and wherein the ac frequency ratios l:m:n are rational numbers.

11. The method of claim 10, wherein one of l, m, and n has a unique numerical parity and wherein the initial direction of the vorticity axis is parallel to the ac magnetic field component that has the unique numerical parity.

12. The method of claim 11, wherein two of the ac frequencies are odd and the third ac frequency is even and wherein the initial direction of the vorticity axis is parallel to the even field axis.

13. The method of claim 12, wherein the dc field is applied to one of the odd field axes, thereby causing the vorticity axis to reorient from the initial direction parallel to the even field axis to a direction parallel to the other odd field axis.

14. The method of claim 11, wherein two of the ac frequencies are even and the third ac frequency is odd and wherein initial direction of the vorticity axis is parallel to the odd field axis.

15. The method of claim 14, wherein the dc field is applied to the odd field axis, thereby causing the vorticity axis to reorient from the initial direction parallel to the odd field axis to a direction parallel to one of the even field axes.

16. The method of claim 11, wherein all three of the ac frequencies are odd and wherein the dc field is applied to one of the odd field axes.

17. The method of claim 1, wherein the triaxial magnetic field comprises two mutually orthogonal ac magnetic field components and one mutually orthogonal dc magnetic field component, thereby establishing vorticity in the fluidic suspension having an initial vorticity axis parallel to one of the ac magnetic field components; and wherein transitioning the symmetry of the triaxial magnetic field comprises progressively replacing the mutually orthogonal dc magnetic field component with an ac magnetic field component.

18. The method of claim 17, wherein the two ac magnetic fields have different ac frequencies l and m, wherein l and m are relatively prime and wherein the frequency ratio l:m is a rational number and wherein at least one of l and m is odd.

19. The method of claim 18, wherein only one of l and m is odd and wherein the initial direction of the vorticity axis is parallel to the odd field axis.

20. The method of claim 18, wherein both l and m are odd and wherein the initial direction of the vorticity axis is parallel to the dc magnetic field component.

* * * * *